US006967669B2

(12) United States Patent
Castle et al.

(10) Patent No.: US 6,967,669 B2
(45) Date of Patent: Nov. 22, 2005

(54) ACCUMULATOR DRUM AND METHOD OF USE FOR AN IMAGE FORMING APPARATUS

(75) Inventors: Scott R. Castle, Lexington, KY (US); Frank M. Hughes, Paris, KY (US); Edward A. Rush, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/392,571

(22) Filed: Mar. 20, 2003

(65) Prior Publication Data

US 2004/0183881 A1 Sep. 23, 2004

(51) Int. Cl.[7] ..... G03G 15/01
(52) U.S. Cl. ..... 347/115; 399/302
(58) Field of Search ..... 347/115, 119, 232, 347/233; 399/302, 299, 298, 308, 178, 179, 399/167, 111

(56) References Cited

U.S. PATENT DOCUMENTS 4,935,788 A * 6/1990 Fantuzzo et al. ..... 399/299
5,799,232 A * 8/1998 Tompkins et al. ..... 399/167
5,870,659 A * 2/1999 Maruyama et al. ..... 399/299
5,953,566 A * 9/1999 Fujiwara et al. ..... 399/223
6,133,927 A * 10/2000 Arai et al. ..... 347/131
6,556,798 B2 * 4/2003 Rimai et al. ..... 399/167
6,636,340 B1 * 10/2003 Hama et al. ..... 359/204
2001/0019674 A1 * 9/2001 Asano et al. ..... 399/223
2002/0080219 A1 * 6/2002 Yamaguchi et al. ..... 347/115
2002/0114650 A1 * 8/2002 May et al. ..... 399/302

* cited by examiner

*Primary Examiner*—Daniel J. Colilia
*Assistant Examiner*—Leo T. Hinze
(74) *Attorney, Agent, or Firm*—Coats & Bennett, PLLC

(57) ABSTRACT

An image forming apparatus comprising an accumulator drum for receiving toner images from a plurality of imaging units and transferring the toner images to a receiving media. The basic components of the image forming apparatus comprise an accumulator drum having a plurality of imaging units with photoconductive drums positioned about the accumulator drum, and a laser assembly. In one embodiment, a laser emits light beams for forming a latent image on each of the photoconductive drums with each light beam having a different external optical path length. In one embodiment, a drive mechanism operatively connected to the imaging units drives the accumulator drum. In one embodiment, the imaging units are positioned about the accumulator drum is a specific angular placement. In one embodiment, the imaging units are at least partially positioned within the interior of the accumulator drum.

8 Claims, 6 Drawing Sheets

ACCUMULATOR DRUM AND METHOD OF USE FOR AN IMAGE FORMING APPARATUS

BACKGROUND

The present invention relates generally to image forming devices, and particularly to image forming devices that use accumulator drums to transfer toner to a recording medium.

Some image forming devices include an intermediate transfer belt (ITM belt) for image formation. A toner image is created by imaging units and transferred to the ITM belt. The ITM belt than transfers the toner image to a second transfer point where the toner image is transferred to a recording sheet. While adequate, an image forming device utilizing an ITM belt has drawbacks.

Size constraints are a major selling point for purchasers selecting an image forming device. Smaller sizes provide for the device to be placed within a workspace without interfering with other activities. Additionally, a smaller size eases the transporting the device, either upon initial set-up, or during the life of the device when it may be moved to various workspaces. ITM belts may require that the overall size of the image forming device being large. The size is necessitated by the plurality of imaging units being aligned in a row along the ITM belt. Another selling point for purchasers is the overall cost of the device. Cost becomes a major consideration due to the tightening economy with individuals and businesses trying to save expenses. An image forming device having an ITM belt may result in the overall cost of the device being higher.

One design of eliminating the ITM belt is an image device featuring an accumulator drum. Accumulator drums are generally cylindrical and receive the toner images from each of the image forming units. Accumulator drum designs may permit the overall size of the image forming device to be smaller. Additionally, accumulator drum designs may further provide for a decrease in the overall cost of the image forming device.

However, the use of accumulator drums presents a new set of technical challenges. For example, it is difficult to maintain a common imaging mechanism for a plurality of colors on a curved surface of the accumulator drum than it is for a planar surface of the ITM belt. These difficulties are even more pronounced as the radius of the accumulator drum decreases relative to the radii of the photoreceptor drums. Therefore, there is a need for a system and method that maintains common imaging development in electrophotographic devices that use accumulator drums instead of ITM belts.

SUMMARY

The present invention is directed to an image forming apparatus having an accumulator drum. The accumulator drum has a substantially circular cross-sectional shape and is sized to receive toner images from one or a plurality of imaging devices and transfer the toner images to a media sheet.

In one embodiment, the accumulator drum includes a single laser assembly which emits a plurality of laser beams to the plurality of imaging devices. Each of the total optical path lengths is substantially the same, but at least two or more of the beams have different external optical path lengths.

In one embodiment, a plurality of imaging devices each include a photoconductive drum and produce a toner image of different color which is transferred to the accumulator drum. One or more of the photoconductive drums drive the rotation of the accumulator drum. One or more drive mechanisms are operatively connected to the driving photoconductive drums which in turn cause rotation of the accumulator drum.

In one embodiment, a plurality of imaging devices are positioned around the arcuate surface of the accumulator drum. The imaging device are arranged such that the photoconductive drums of the imaging devices are spaced along an arc. A single laser assembly emits a laser beam to each of the imaging devices.

In another embodiment, the accumulator drum has a hollow interior. The imaging devices are positioned within at least a portion of the hollow interior to minimize the overall size of the image forming apparatus. The imaging devices are constructed to straddle the accumulator drum with a first section positioned within the hollow interior and the second section positioned on an exterior.

Various combinations of embodiments are further included each utilizing the shape and dimensions of the accumulator drum.

DETAILED DESCRIPTION

Figure 1:
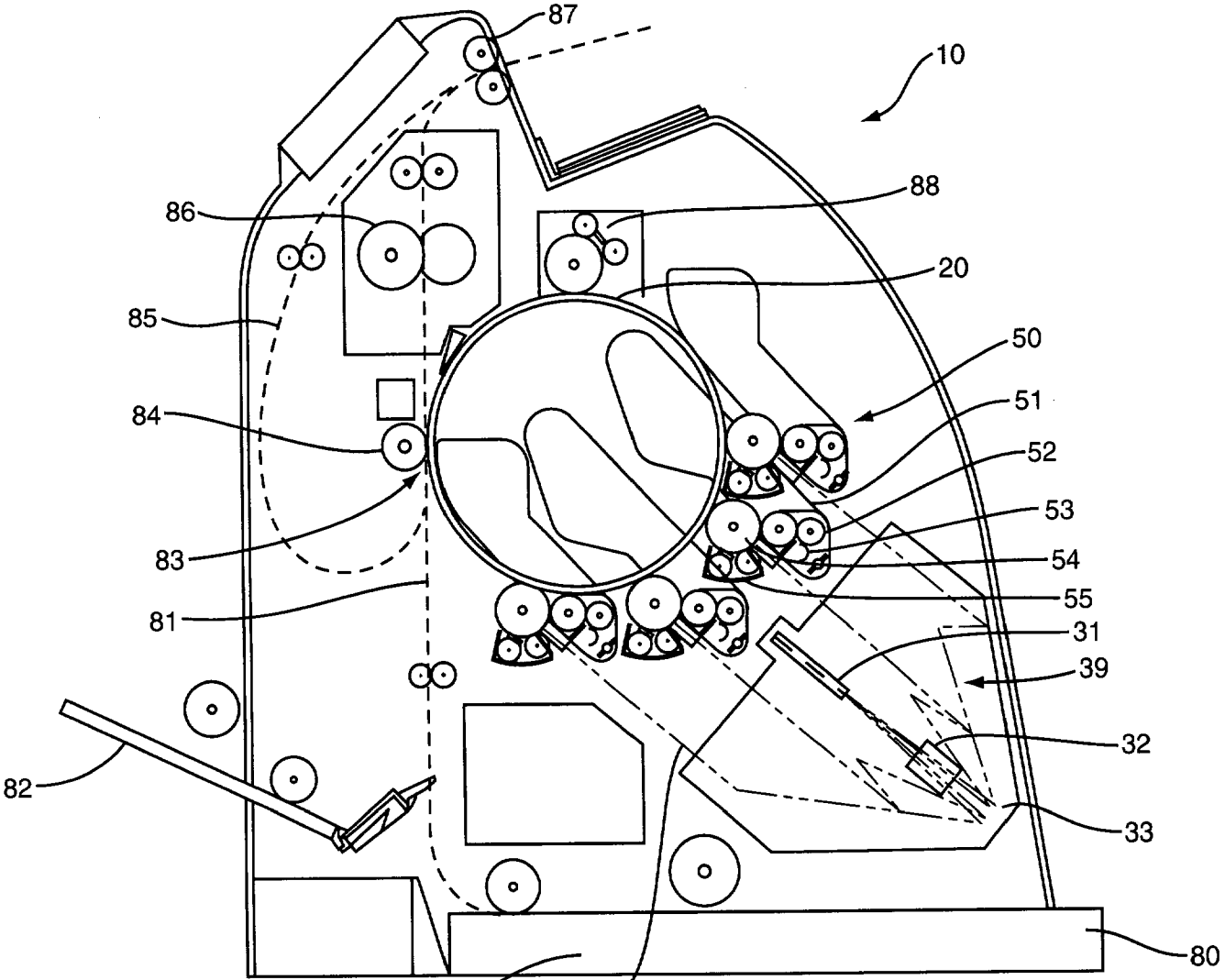
FIG. 1 is a side view illustrating one embodiment of the image forming apparatus of the present invention.

The present invention is directed to an image forming apparatus, generally illustrated 10, comprising an accumulator drum 20 for receiving toner images from a plurality of imaging units 50 and transferring the toner images to a receiving media. The basic components of the image forming apparatus 10 comprise an accumulator drum 20, a plurality of imaging units 50 with photoconductive drums 54 positioned about the accumulator drum 20, and a laser assembly 30. In one embodiment, the laser assembly emits beams 35 for forming a latent image on each of the photoconductive drums 54 with each beam 35 having an optical pathway of a different length. In one embodiment, a drive mechanism 40 operatively connected to the imaging units 50 drives the accumulator drum 20. In one embodiment, the imaging units 50 are positioned about the accumulator drum 20 in a specific angular placement. In one embodiment, the imaging units 50 are at least partially positioned within the interior of the accumulator drum 20.

Figure 2:
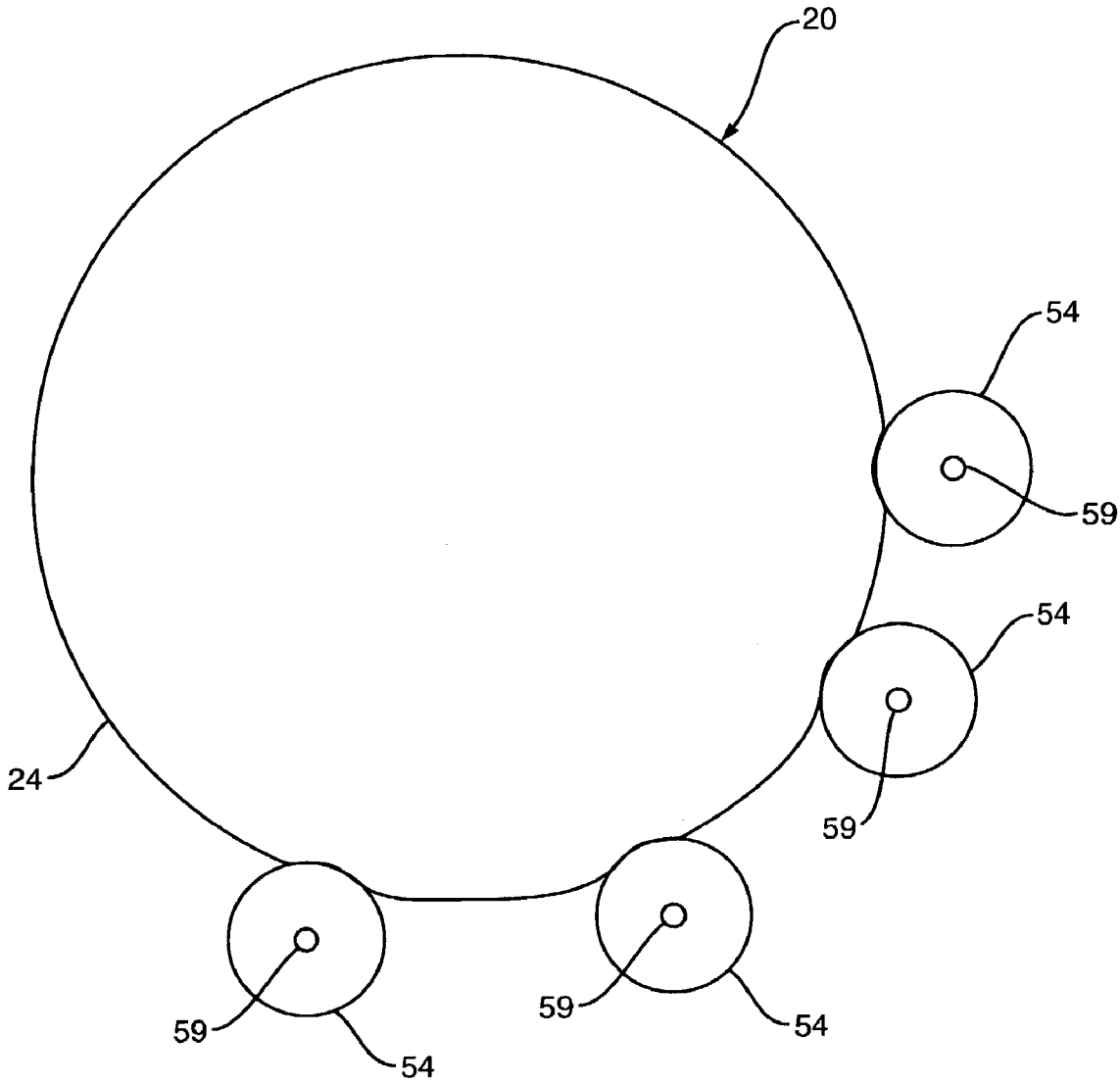
FIG. 2 is a schematic diagram illustrating the surface of the accumulator drum being deformed against the photoconductive drums.

FIG. 1 illustrates one embodiment of the present invention. The accumulator drum 20 receives a toner image from the imaging devices 50 and transfers the toner image to a recording media at a second transfer area 83. In one embodiment, accumulator drum 20 is substantially cylindrical having a circular cross-section with an outer surface extending between first and second ends 21, 22. The outer surface of the drum 20 is substantially smooth to receive the toner image from each of the photoconductive drums 54. In one embodiment, the interior of the accumulator drum 20 is hollow such that toner hoppers of the imaging units fit within as will be explained in detail below. The drum 20 may have a variety of circumferences and lengths depending upon the application of use. In one embodiment, the circumference is about seventeen inches to receive toner images transferred to legal-sized media sheets. In one embodiment as illustrated in FIG. 2, the accumulator drum 20 has an outer surface 24 that deforms when contacting the photoconductive drums 54. The outer surface 24 of the accumulator drum 20 maintains a substantially circular cross-sectional shape where there is no contact with the photoconductive drums 54. In the contact areas, the outer surface 24 deforms about the photoconductive drums 54. Accumulator drum 20 deformation results in greater surface contact between the accumulator drum 20 and the photoconductive drums 54. The deformation is caused by the difference in hardness between the accumulator drum 20 and the photoconductive drums 54. Hardness is the resistance of a material to indentation and can be determined according to one of several scales including Shore. In one embodiment, the amount of deformation is also a function of the normal force between the drum 20 and photoconductive drums 54. The amount of deformation between the accumulator drum 20 and the photoconductive drums 54 can be adjusted depending upon the desired parameters. Greater surface contact occurs when there is a large difference in hardness between the photoconductive drums 54 and the accumulator drum 20. In one embodiment, equal amounts of deformation occur at each photoconductive drum 54 because each of the accumulator drums 20 has the same hardness. In one embodiment, at least two of the photoconductive drums 54 have different hardnesses such that the amount of amount of accumulator drum 20 deformation is different.

Imaging units 50 form a toner image that is transferred to the adjacently-positioned accumulator drum 20. Each imaging unit 50 has similar elements but is distinguished by the toner color contained therein. In one embodiment, imaging units 50 include a black unit, a magenta unit, a cyan unit, and a yellow unit. In one embodiment, the imaging units 50 form individual images of a single color that are combined in layered fashion to create the final multicolored image. As the imaging units 50 contain the same elements, one unit and elements will be described, with the other imaging units being omitted for simplification.

Photoconductive drum 54 is generally cylindrically-shaped with one end having a means for coupling with a drive mechanism 40 for rotational movement that will be described in detail below. Photoconductive drum 54 has a smooth surface for receiving an electrostatic charge over the surface as the drum 54 rotates past charge roller 55. The photoconductive drum 54 continuously and uniformly rotates past a laser assembly 30 that directs a laser beam 35 onto selected portions of the photoconductive drum surface forming an electrostatic latent image representing the image to be printed. The photoconductive drum 54 is rotated at a constant speed as the laser beam 35 is scanned across its length. This process continues as the entire image is formed on the drum surface.

After receiving the latent image, the photoconductive drum 54 rotates past a toner area having a toner hopper for housing the toner and a developer roller 51 for uniformly transferring toner to the photoconductive drum 54. In one embodiment, the toner is a fine powder usually composed of plastic granules that are attracted and cling to the electrostatic latent image formed on the photoconductive drum surface by the laser assembly 30. A toner adder roller 52 may be positioned to move toner against the developer roller 51. A doctor blade 53 is positioned against the developer roller 51 to control the amount of toner. In one embodiment, doctor blade 53 is positioned below the developer roller 51.

Figure 3:
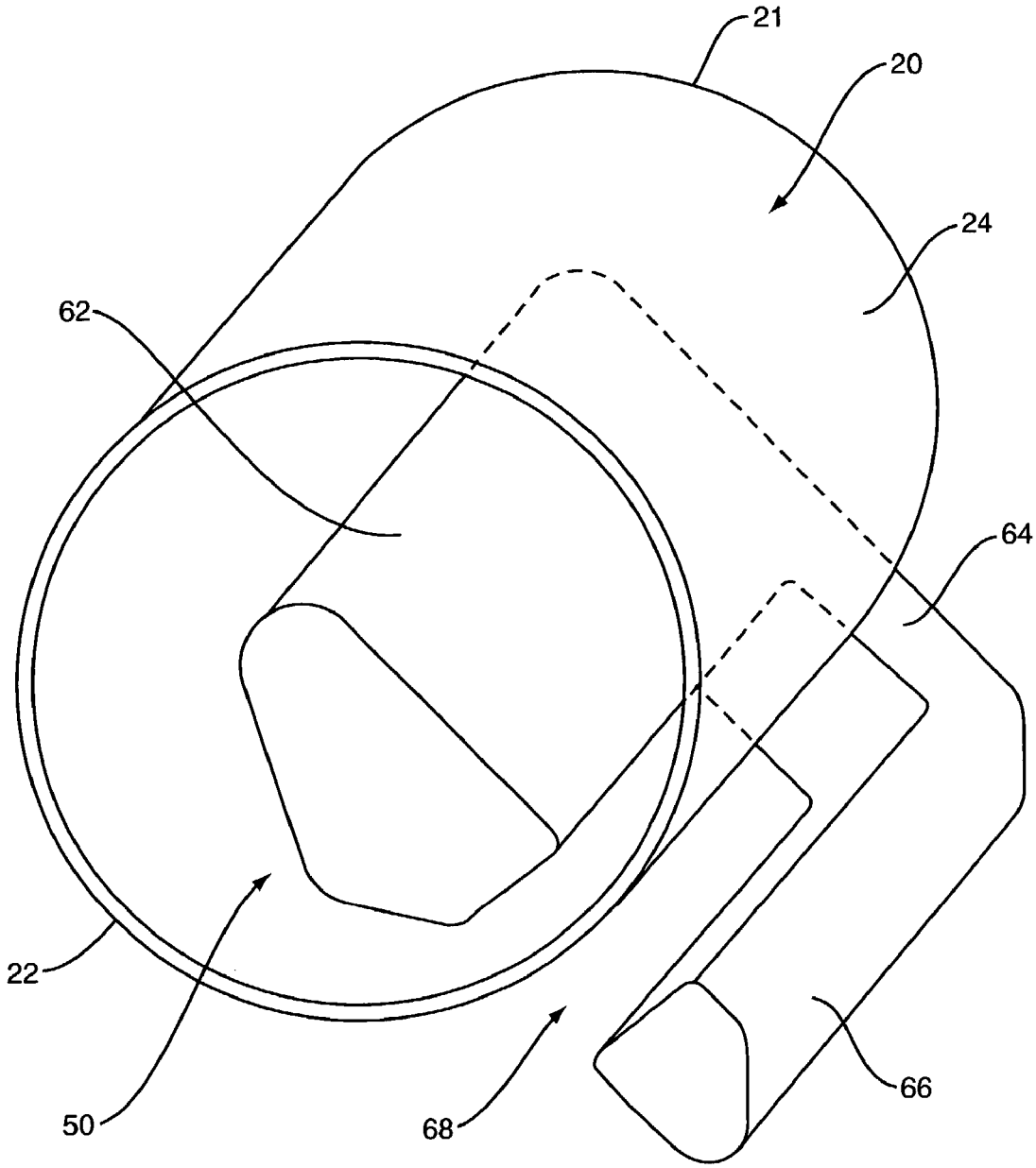
FIG. 3 is a perspective view of one embodiment of an imaging unit structured to straddle the accumulator drum.

FIG. 3 illustrates one embodiment of an imaging unit 50 comprising a first section 62, a middle section 64, and a second section 66. The overall configuration of the imaging unit 50 allows for utilizing the interior space of the accumulator drum 20. In one embodiment the first section 62 is positioned within the interior of the accumulator drum 20 and the second section 64 is positioned on the exterior with the photosensitive drum 54 positioned against the accumulator drum outer surface 24. The middle section 64 straddles the accumulator drum 20 without interfering with drum rotation. A gap 68 is formed between the first section 62 and the second section 66. Gap 68 has a width such that the accumulator drum 20 can fit within. In one embodiment as illustrated in FIG. 3, the overall configuration of the imaging unit 50 has a substantially U-shape.

In one embodiment, first section 62 has an interior volume to maintain a large amount of toner, and the second section 66 includes the photoconductive drum 54, developer roller 51, and charge roller 55. In one embodiment, the first and second sections 62, 66 have a length approximately equal to the length of the accumulator drum 20. In one embodiment, imaging unit 50 is positioned within the device 10 such that gravity can feed the toner from the first section 62, through the middle section 64, and against the photoconductive drum 54 within the second section 66.

In one embodiment, a toner movement system moves the toner. Agitating members within the sections 62, 64, 66 move the toner from the first section 62 to the second section 66 and against the photoconductive drum 54. In one embodiment, first section 62 includes a first auger, middle section 64 includes a middle auger, and second section 66 includes a second auger. The augers work in combination to move the toner throughout the interior of the imaging unit 50.

There are a variety of arrangements for positioning the imaging devices 50 relative to the accumulator drum 20. In one embodiment, each of the imaging units 50 is designed such that a portion is located within the interior of the accumulator drum 20. In one embodiment such as illustrated in FIG. 1, at least one imaging unit 50 is completely positioned on the exterior of the accumulator drum 20. In one embodiment, the imaging units 50 outside the accumulator drum 20 have a larger capacity and can hold more toner than the other imaging units 50. In one embodiment, black toner is stored in one of the exterior imaging units 50.

In one embodiment, two or more of the imaging units 50 have the same construction. By way of example, the embodiment illustrated in FIG. 1 features the first and fourth imaging units 50 having the same construction, and the second and third imaging units 50 having the same construction. The difference between the imaging units 50 with a common construction is the color of toner contained within. Using the same construction for different imaging units 50 reduces the amount of manufacturing and warehousing requirements.

Laser assembly 30 forms a latent image on each of the photoconductive drums 54. Laser assembly 30 comprises a laser 31 that emits a plurality of laser beams 35. A separate laser beam 35 is emitted by the laser 31 and directed to each photoconductive drum 54. Laser assembly 30 further comprises at least one lens 32 and may include a mirror 33. The term "optical path element" is defined as an element that effects the direction or focuses the laser beam through which the laser beam 35 travels between the laser 31 and the surface of the photoconductive drum 54. In one embodiment, the lens 32 and mirror 33 are each optical path elements. Laser beams 35 may travel through one or a plurality of optical path elements.

Figure 4:
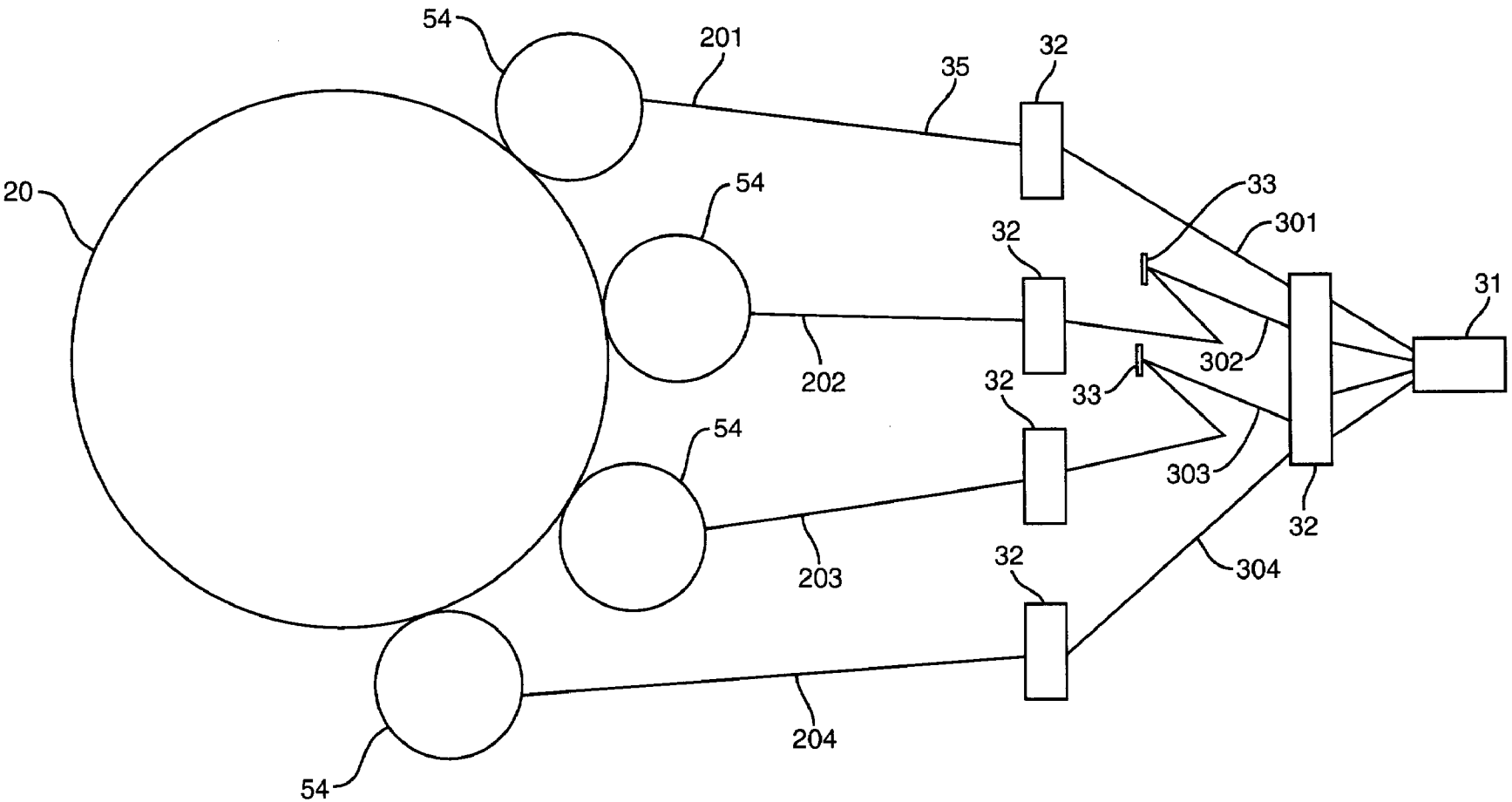
FIG. 4 is a schematic illustration of the optical path length of the laser assembly.

FIG. 4 illustrates one embodiment of the laser 31, optical elements, and photoconductive drums 54. Each laser beam 35 is divided into two sections: an internal section extending between the laser 31 and the last (i.e., downstream) optical path element; and an external section extending from the last optical path element to the photoconductive drum 54. By way of example, a first laser beam comprises an internal section 301 and an external section 201, a second laser beam comprises internal section 302 and an external section 202, a third laser beam comprises internal section 303 and external section 203, and fourth laser beam comprises internal section 304 and external section 204. Each laser beam has the same total path length (i.e., internal section and external section). By way of example, the total path length of the first laser beam is internal section 301 plus external section 201. This total path length is equal to the total path length of the second laser beam (internal section 302 plus external section 202), which is equal to the total path length of the third laser beam (internal section 303 plus external section 203), which is equal to the total path length of the fourth laser beam (internal section 304 plus external section 204). The external section of the optical path length is different for at least two of the laser beams. In one embodiment, the external section of the optical path length is different for each laser beam.

In one embodiment, at least two of the photoconductive drums 54 are positioned a different physical distance away from the laser assembly 30. In one embodiment, this distance is defined as being from a center point 59 of the photoconductive drum 54 to a mid-point of the laser 31. In one embodiment, four photoconductive drums 54 are each positioned a different physical distance away from the laser assembly 30.

Figure 5:
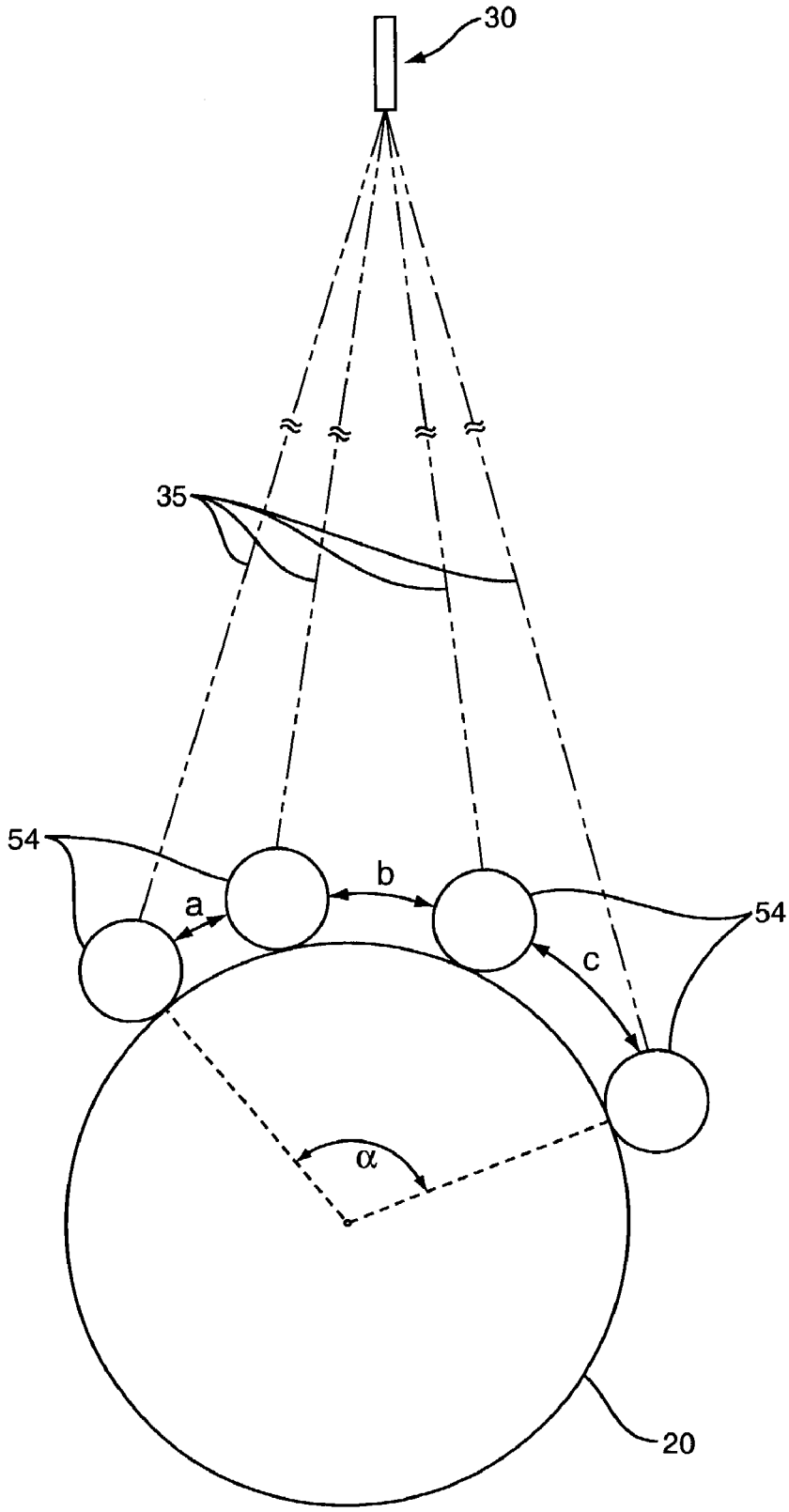
FIG. 5 is a schematic diagram illustrating the laser assembly, photoconductive drums and accumulator drum.

The imaging units 50 are arranged with each photoconductive drum 54 contacting the surface of the accumulator drum 20. The distance between each of the photoconductive drums 54 may vary depending upon the application. In one embodiment illustrated in FIG. 5, four photoconductive drums 54 are positioned adjacent to the accumulator drum 20. The photoconductive drums 54 are separated by varying distances, with distance a between the first and second drums being different than distance b between the second and third drums being different than distance c between the third and fourth drums.

The photoconductive drums 54 are arranged along a span of the accumulator drum surface to be accessible to a single laser assembly 30. An angle $\alpha$ is formed between the upstream and downstream photoconductive drums 54. In one embodiment, the angle $\alpha$ is in the range of between about 75 and about 125 degrees. In one preferred embodiment, the angle $\alpha$ is 125 degrees which is adequate to space the photoconductive drums 54 along the accumulator drum 20 and provide for a single laser assembly 30 to emit a laser beam 35 on each photoconductive drum 54.

Figure 6:
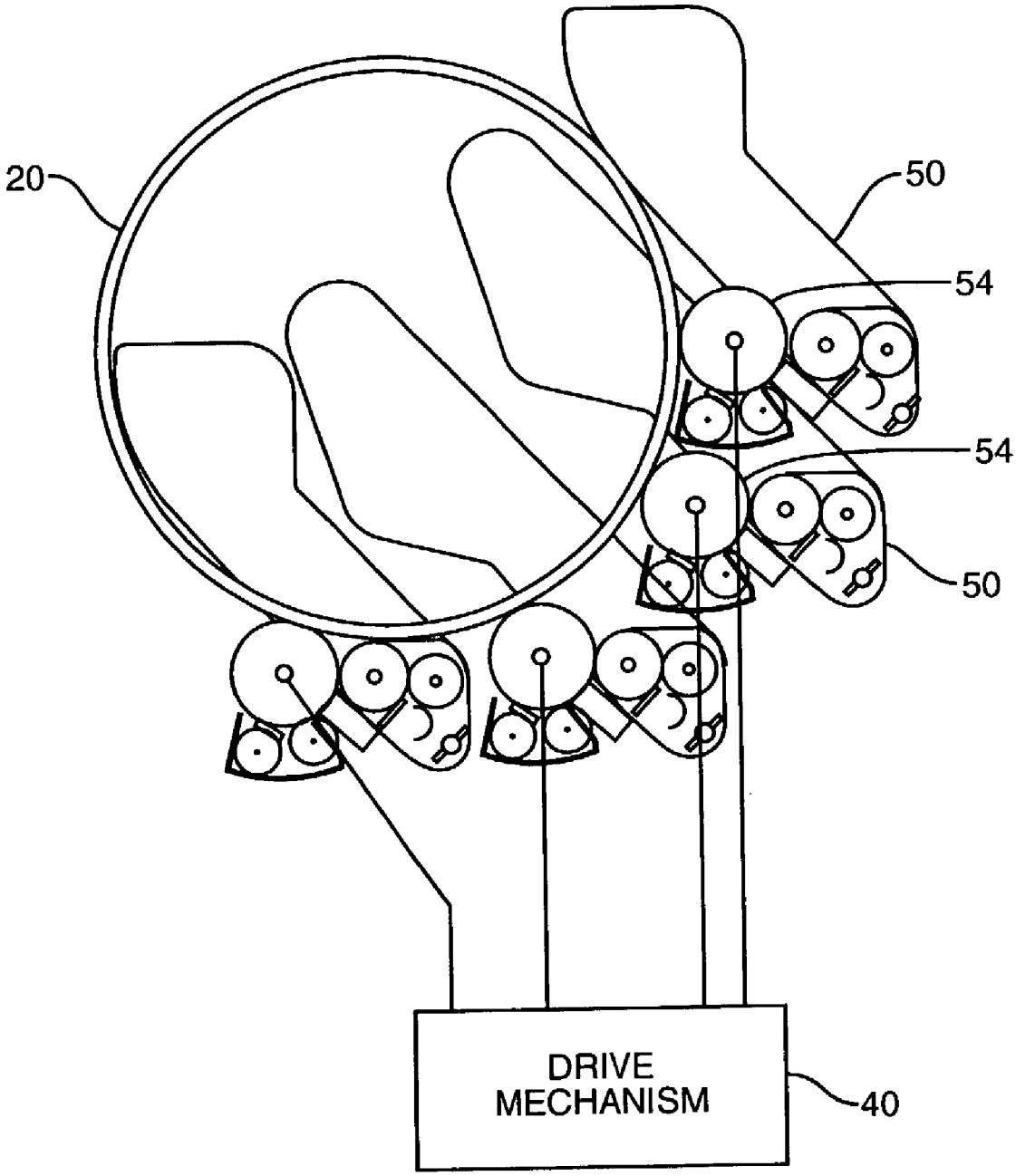
FIG. 6 is a schematic illustration of a drive mechanism and the photoconductive drums of the imaging units.

A drive mechanism 40 provides rotation for the photoconductive drums 54. In one embodiment illustrated in FIG. 6, a drive mechanism 40 is operatively connected to the imaging units 50 to rotate each of the photoconductive drums 54. In one embodiment, the accumulator drum 20 does not include a separate drive mechanism but is driven by the photoconductive drums 54. Each of the photoconductive drums 54 contacts the accumulator drum 20 and the rotational force is transferred to rotate the accumulator drum 20. The friction formed between the surface of the photoconductive drums 54 and the accumulator drum 20 is adequate for the driving force to be adequately transferred to the accumulator drum 20. In one embodiment, the accumulator drum 20 and the photoconductor drums 54 each rotate with the same linear surface velocity. In one embodiment, slippage occurs between the surface of the photoconductive drums 54 and the accumulator drum 20. In one embodiment, the slip range is between about 0% and about 3% with the accumulator drum 20 lagging the driving photoconductive drums 54. In one embodiment, the accumulator drum 20 is positioned on bearings within the image forming apparatus 10. The bearings allow for the accumulator drum to freely rotate such that the driving force applied by the driving mechanism is transferred fully to the accumulator drum.

In one embodiment, each imaging unit 50 comprises a gear that mates with the drive mechanism 40 within the image forming apparatus 10. The imaging units 50 are mountable within the apparatus 10 such that the drive gear within the apparatus 10 mates with a gear on the exterior of the imaging unit. In one embodiment, each imaging unit 50 is driven by a separate drive mechanism in a one-to-one orientation.

A media sheet is introduced to a paper path 81 through a tray 80 or multi-purpose feeder 82. A series of rollers and/or belts transports the sheet to the second transfer area 83 where the sheet contacts the accumulator drum 20 and receives the composite toner image. In one embodiment, voltage is applied to the transfer roller 84 that pushes the media sheet against the accumulator drum 20 to pull the charged toner away from the drum and onto the sheet. The sheet and attached toner image next travel through a fuser 86 having a pair of rollers and a heating element that heats and fuses the toner to the sheet. In one embodiment, the fuser comprises a belt fuser and roller. The sheet with fused image is then transported out of the image forming apparatus 10. A duplexing path 85 provides for inverting the sheet and forming an image on the opposite side.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An image forming apparatus comprising:

a. an accumulator drum having a substantially cylindrical shape with an first end that is open and an interior section; and b. a plurality of imaging units each having a first section to store toner and a second section having a photoconductive drum positioned against an outer surface of the accumulator drum forming a toner image that is transferred to the accumulator drum, each of the plurality of imaging units straddling the accumulator drum with the first section positioned within the interior section and the second section positioned on an exterior of the accumulator drum.

2. The apparatus of claim 1, further comprising an exterior imaging unit having a photoconductive drum positioned against the outer surface of the accumulator drum, the exterior imaging unit having a toner storing section positioned on the exterior of the accumulator drum and having a volume greater than said plurality of imaging units.

3. The apparatus of claim 2, wherein the exterior imaging unit contains black toner.

4. The apparatus of claim 1, wherein the plurality of imaging units further comprise a middle section extending between the first section and the second section with the overall shape being substantially U-shaped.

5. The apparatus of claim 1, further comprising a single laser assembly that forms a latent image on each of the photoconductive drums.

6. An image forming apparatus comprising:

a. an accumulator drum having a cylindrical shape with an arcuate outer surface and an interior space;

b. a plurality of imaging units each having a first section to store toner and a second section having a photoconductive drum, each of the plurality of imaging units straddling the accumulator drum with the first section positioned within the interior space of the accumulator drum and the second section positioned on an exterior with the photoconductive drum contacting the outer surface of the accumulator drum;

c. a laser emitting a plurality of beams to form a latent image on each of the photoconductive drums, each of the plurality of beams having an optical pathway of different lengths;

d. a drive mechanism operatively connected to each of the plurality of imaging units to rotate each of the photoconductive drums; and e. the accumulator drum being in contact with each of the photoconductive drums with friction between each of the photoconductive drums and the accumulator drum causing the accumulator drum to rotate.

7. An image forming apparatus comprising:

a. an accumulator drum having a substantially cylindrical shape with an interior space and a first end that is open; and b. a plurality of imaging units each having a first section to store toner and a second section having a photoconductive drum positioned against an outer surface of the accumulator drum forming a toner image that is transferred to the accumulator drum, the first section of at least one of the imaging units being positioned within the interior space of the accumulator drum.

8. The apparatus of claim 7, wherein the first sections of all of the imaging units are positioned within the interior space of the accumulator drum.

* * * * *